US006763900B2

(12) United States Patent
Miszewski

(10) Patent No.: US 6,763,900 B2
(45) Date of Patent: Jul. 20, 2004

(54) DIRECTIONAL WELL DRILLING

(75) Inventor: Antoni Miszewski, Budleigh Salterton (GB)

(73) Assignee: Antech Limited, Exeter (GB)

( * ) Notice: Subject to any disclaimer, the term of this patent is extended or adjusted under 35 U.S.C. 154(b) by 228 days.

(21) Appl. No.: 10/012,824

(22) Filed: Oct. 30, 2001

(65) Prior Publication Data

US 2002/0050410 A1 May 2, 2002

(30) Foreign Application Priority Data

Oct. 27, 2000 (GB) ..... 0026315

(51) Int. Cl.[7] ..... E21B 7/08
(52) U.S. Cl. ..... 175/61; 175/75; 175/62
(58) Field of Search ..... 175/61, 62, 73, 175/75, 325.1, 325.2

(56) References Cited

U.S. PATENT DOCUMENTS 5,314,032 A 5/1994 Pringle et al.
5,423,389 A * 6/1995 Warren et al.
5,467,834 A * 11/1995 Hughes et al.
5,547,031 A * 8/1996 Warren et al.

FOREIGN PATENT DOCUMENTS

EP 1 008 717 6/2000
GB 2278137 * 11/1994

* cited by examiner

*Primary Examiner*—Roger Schoeppel
(74) *Attorney, Agent, or Firm*—Herbert Dubno

(57) ABSTRACT

An orienter for controlling the drilling direction in a well. A main body 40, 23 is couplable to a drill string, and a nose tubing 50 is movably mounted by a universal joint in the main body. A collar 42 with a bore 43 engages in a cam-like manner with an extension 26 of the nose tubing on the drill string side of the universal joint. The collar is movable longitudinally 'a' to control the magnitude 'b' of the nose tubing, and circumferentially 'c' to control the azimuth 'd'. The nose tubing is aligned on both sides of the universal joint and the bore of the collar is angled relative to the main axis of the main body. The collar may be hydraulically or electrically controlled.

6 Claims, 4 Drawing Sheets

DIRECTIONAL WELL DRILLING

FIELD OF THE INVENTION

This invention relates to direction drilling of bores, particularly (though not exclusively) to produce fluid such as oil or gas from an underground formation.

BACKGROUND OF THE INVENTION

When drilling a borehole to extract oil or gas from an under-ground formation, it is often desirable to drill the borehole so that it includes one or more bends or curves. For example, it nay be necessary to avoid an existing well, or to aim for the reservoir to be exploited. Similarly, in drilling a borehole to take piping and/or cables beneath a road or river, it is necessary to guide the course of the borehole.

Wells are drilled using a drill string which consists of a drill pipe with a bottom hole assembly at its bottom end. Traditionally, the drill string has been rotated. With such a string, directional control is achieved by providing a collar around the bottom hole assembly which can be locked to the sides of the bore. The collar has a hole through which the main rotating body of the bottom hole assembly passes. This hole is offset to skew the body of the bottom hole assembly and so cause the bore to deviate from straightness.

More recently, drill strings using coiled tubing have become popular. With this, the drill string is non-rotating, and carries a motor at the bottom of the bottom hole assembly. The motor is driven either by the fluid pumped down the drill string or electrically. (Fluid flow through the drill string is required to wash away the debris resulting from the drilling and to lubricate the system.)

With a coiled tubing drill string, the bottom hole assembly can include a bent sub having nose tubing which carries the motor at its end. The drilling thus automatically tends to deviate from straightness. The bottom hole assembly also includes an orienter, which can be operated to turn the bent sub to control the bearing (as seen looking along the bottom hole assembly) of the deviation of the drilling. GB 2 271 791 A (Camco/Pringle) is in essence an example of this.

The use of a bent sub results in the drilling deviating continuously. Typically, however, it will be desired to drill a borehole which is curved along only a part or parts of its length, with the remainder being straight. There are two techniques for achieving this with the use of a bent sub.

One is to include the bent sub in the bottom hole assembly only for those portions of the bore where deviation is desired; at the beginning and end of each such portion, the directional drilling assembly is removed from the borehole, the bent sub removed or attached, and the drill string re-introduced to the bore hole. Having to interchange straight and directional drilling assemblies adds to the time and cost of a drilling operation.

The second technique is to rotate the orienter continuously in order to produce a nearly straight borehole. This is an inefficient and inaccurate way of producing a straight-pathed borehole. Further, rotating the orienter to simulate straight drilling, or to change or control the azimuthal angle of the directional drilling assembly, is made difficult due to friction between the drill string below the angled portion of the bent sub and the walls of the borehole, or the walls may completely block such rotation. It will be seen that this depends oil the length of the drill string below the angled portion of the bent sub, the angle of the bent sub, the diameters of the borehole and the drill assembly, and the path of the borehole.

Another difficulty associated with such a directional drilling assembly's drill bit exerts a torsional force upon the bent sub and orienter, acting to change the azimuthal angle of the bent sub. As the drill string beneath the bend in the bent sub is straight, the torque exerted by the drill bit is proportional to, amongst other factors, the angle through which the bent sub is bent, and the distance between the drill bit and the bend of the bent sub. These torsional stresses may be compounded. if the drill bit is misaligned relative to the lower portion of the bent sub.

Further, some orienters cannot rotate while there is weight-on-bit, either because of the operation of their actuating mechanism, or because they are simply not powerful enough.

With bent subs, and with most orienters, there is only one degree of control, the azimuth of the deviation, i.e. the angle which the bent sub or orienter produces in the 360° range as seen looking longitudinally along the drill string. The magnitude of the deviation, is the angle between the axis of the drill string and the bent sub or orienter, is fixed (at a few degrees). However, GB 2 278 137 A (Camco/Pringle & Morris) shows a down hole assembly having a bent sub with a movable joint. The movable body, which is coupled to the main housing by a universal joint, has its upper end enclosed in a bore in the end of the housing, and normally hangs freely in the straight position. A mandrel can withdraw the movable body into the housing; the movable body has an offset head end which forces it to skew relative to the housing. The movable body is keyed to the housing to prevent rotation. Thus this can achieve a certain amount of control over the magnitude of the deviation.

GB 2 271 795 A, Stirling Design/Head shows an orienter which provides azimuth control. An annular piston can be moved longitudinally, and has helical engagement to convert the movement into rotation. This rotation is splined to a collar with an eccentric bore. The central tube of the assembly passes through this bore (emerging as nose tubing carrying the motor and drill bit at its end), so rotation of the collar bends the tube to the side. In the embodiments of FIGS. 8, 9 and 14, magnitude control is also provided. This is achieved by; a separate mechanism attached to the nose of the apparatus.

OBJECT OF THE INVENTION

The main object of the present invention is to provide an improved orienter giving 2 degrees of control.

SUMMARY OF THE INVENTION

According to the invention there is provided an orienter comprising a main body couplable to a drill string, a nose tubing movably mounted in the main body, and a collar with a bore which engages in a cam-like manner with the nose tubing and movable to control the orientation of the nose tubing wherein the collar is movable longitudinally and I circumferentially to control both the angle of inclination and the azimuth of the nose tubing.

Preferably the mounting of the nose tubing is a universal joint. Preferably also the collar engages with an extension of the nose tubing on the drill string side of the universal joint. Preferably also the nose tubing is aligned on both sides of the universal joint and the bore of the collar is angled relative to the main axis of the main body.

The collar is preferably hydraulically or electrically controlled.

BRIEF DESCRIPTION OF THE DRAWING

An orienter embodying the invention will now be described by way of example and with reference to the accompanying drawing in which.

SPECIFIC DESCRIPTION

Figure 1:
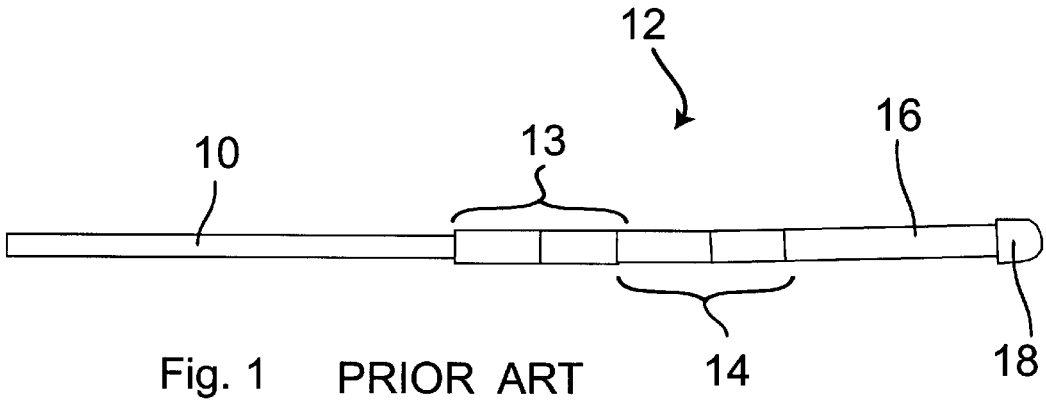
Fig. 1 PRIOR ART
FIG. 1 is a longitudinal view of a prior art directional drill.

FIG. 1 shows a known assembly for introducing a curve into a borehole trajectory. The assembly uses an orienting device 12 on the lower end of the drill pipe 10, and a mud motor 16 and a drill bit 18 on the lower end of the orienting device 12. (Terms like 'upper' and 'lower' refer to the borehole path and the drill string in it extending along from the mouth of the; borehole, since a directionally drilled borehole may include horizontal regions or even regions where the borehole is steered back towards the surface; the left side of the Figs. corresponds to an upwards direction).

The orienting device 12 comprises an orienter 13 and a bent sub 14. The bent sub 14 is set at an angle at the surface corresponding to the degree of curvature desired. The orienter includes a rotatable joint actuated by hydraulic or electrical means so that the bent sub is pointing in the correct direction when considered looking along the drill string immediately above the bent sub (i.e. the correct azimuthal angle). Rather than rotating the entire drill string, which typically occurs in straight drill strings, the drill bit of the directional killing assembly is driven by a mud motor powered by fluid passed down the drill string, since a rotating drill bit would rotate the azimuthal angle of the bent sub.

Figure 2:
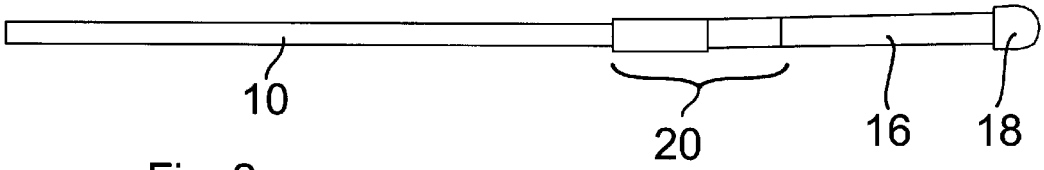
FIG. 2 is a longitudinal view of an embodiment of the directional drilling assembly.

FIG. 2 shows the present directional drilling assembly, which comprises a pointing orienter 20, a mud motor 16, and a drill bit 18, all suspended from a length of drill string 10.

Figure 3:
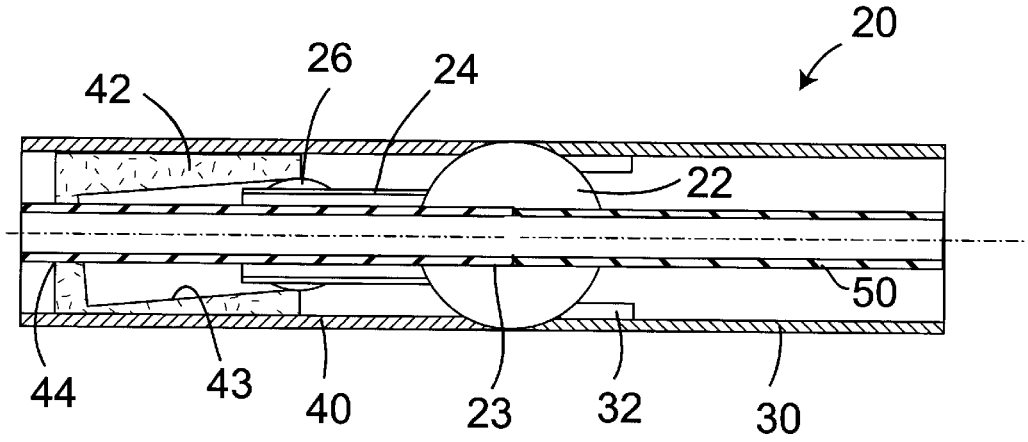
FIGS. 3 to 5 are longitudinal sections of part of the directional drilling assembly in straight, angled, and differently angled orientations respectively.
Figure 4:
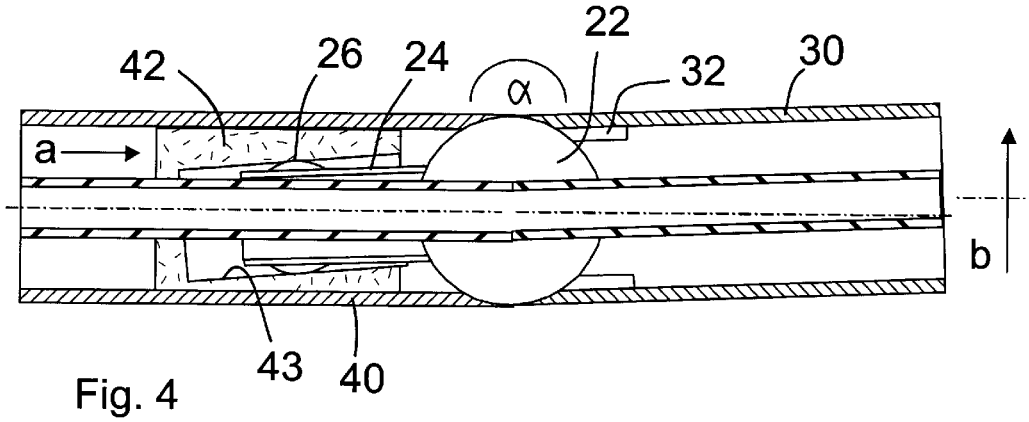
Figure 5:
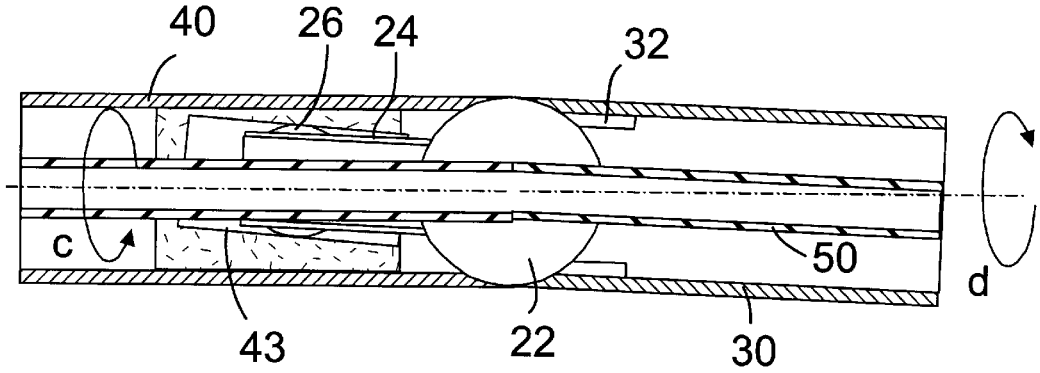

FIGS. 3 to 5 show the present pointing orienter 20 in more detail. The orienter comprises a ball joint 22, crank arm 24 and bearing 26 secured to a lower housing 30, and a bearing block 42 mounted in an upper housing 40. A flowtube 50 runs along the center axis of the pointing orienter. The upper and lower housings 40, 30 are tubes having approximately the same outer diameter of the drill string. The ball joint 22 is spherical and is also approximately the drill string's diameter. The ball joint 22 is set in the lower housing 30 so that half the sphere 22 extends from the lower housing 30 (half the sphere being contained within the lower housing); the thickness of the tube of the lower housing 30 is bevelled to accommodate the ball joint. The ball joint 22 is securely fixed to the lower housing 30, and to mounting blocks 32 set in the inner diameter of the lower housing. The ball joint 22 includes a through bore 23 running along the center axis of the lower housing, the through bore having a sufficient diameter to accommodate the flowtube 50.

A tubular crank arm 24 extends upwards from the ball joint 22. The crank arm has a smaller diameter than the lower housing 30, and is coaxial with it. Towards the end opposite the ball joint 22, there is an annular bearing 26 surrounding the crank arm 24, the outer surface of the bearing being curved. The shape of the bearing 26 is part of a sphere, the central axis of the crank arm intersecting the mid-point of this sphere.

The hearing block 42 comprises a cylinder having a chamber formed from both a blind bore 43 excised from it, and a through bore 44 extending beyond the end of the blind bore. The hearing block 42 has an outer diameter somewhat less than the inner diameter of the upper housing 40, and is slidable moveable therein both axially and rotationally, this movement being effected by electric or hydraulic actuators. The through bore 44 allows the flowtube 50 to pass through the bearing block 42, the inner surface of the through bore having a sufficient gap to allow the bearing block to move axially and rotationally around the flowtube 50. The blind bore 43 is cylindrical, has an inner diameter somewhat larger than the outer diameter of the bearing 26, with the axis of the blind bore 43 being inclined from the axis of the upper housing. The inclination of the blind bore's axis from the upper housing's axis is typically about 4°. The mouth of the blind bore 43 forms a circle whose center coincides with the central axis of the upper housing (the mouth of the blind bore will actually be somewhat elliptical, and centered slightly off the center line, but approximates a circle provided the inclination of the blind bore from the upper housing is small).

The lower end of the upper housing 40 includes a curved bevelled edge which fits against the tall joint 22, such that the ball joint may typically rotate through approximately 3° relative to the upper housing.

The upper and lower housings 40, 30 are held or joined in a substantially abutting relationship, for example being secured together by a sleeve of material around their abutting ends. The join between the upper and lower ends must be flexible enough to allow the lower housing 30 to pivot about the ball joint 22 to allow the lower housing to change its inclination relative to the upper housing, and to change the azimuth of the lower housing, but the join should be strong enough to resist the twisting rotation of the lower housing relative to the upper housing (i.e. the angular displacement of abutting points on the upper aid lower housings). An alternative way of forming the pivot part of the device using a spherical Oldham coupling is described below (see FIGS. 6 and 7).

In FIG. 3, the bearing block 42 is shown positioned at its upper limit, the bearing upon the crank arm 24 just engaging with the bearing block's mouth. The lower housing and the upper housing are aligned.

FIG. 4 shows the bearing block 42 displaced downwards from its position in FIG. 3 (indicated by the arrow 'a') by its actuators (the actuators are not shown) to a position about three-quarters of the way between the upper and lower limits of its range and closer to the lower limit. The upper limit of the bearing block is determined such that the bearing 26 is close to the mouth of the bearing block's chamber, and the lower limit is such that the end of the crank arm 24 stops short of or abuts the end of the blind bore 40, or until the crank arm and bearing are constrained from further relative movement between the upper housing and the flowtube.

Since the blind bore 43 is inclined to the axis of the upper housing 40, downward axial displacement (indicated by arrow 'a') of the bearing block 42 from its lower limit causes the tearing 26 to move radially outwards, pivoting about the ball joint 22. The lower housing 30, being secured to the ball joint, pivots to the same degree and direction as the crank arm (indicated by the arrow 'b'). For small inclinations, the angle of inclination (or "angular magnitude") of the lower housing's axis to the upper housing's axis is directly proportional to the axial displacement of the bearing block. At the position shown in FIG. 4, the inclination (indicated by angle '$\alpha$') of the lower housing is approximately 2°, a typical maximum angular inclination being 3°.

Since the mud motor 16 and drill bit 18 are coaxially fixed to the lower housing 30, the drill bit is inclined to the relative to the drill string immediately above the ball joint. Axial displacement of the bearing block 42 therefore causes the drill to bore a curved path according to the inclination from the upper housing.

The torque caused by the rotation of the drill bit at an inclination to the upper housing 40 is substantially transmitted through the lower housing 30 to the upper housing, and not to the actuators displacing the bearing block 42. The actuators therefore need only be strong enough to effect the change of orientation.

Referring to FIG. 5, if the bearing block 42 is rotated (indicated by arrow 'c') about the axis of the upper housing 40 (again by actuators which are not shown), the bearing 26 will describe an arc having that degree of rotation of the bearing block, the radius of the arc depending upon the axial displacement of the bearing block (unless the axis of the crank arm is aligned with the upper housing's axis, in which case rotation of the bearing block will have no effect). The lower housing, and the mud motor and drill bit below, will therefore describe part of a cone (indicated by arrow 'd'). The bearing block is preferably rotatable about a complete 360° turn, ideally it may be rotated with complete freedom.

By a combination of axial and rotational movement of the bearing block, the drill bit may be oriented to any desired inclination (angular magnitude) within a cone having a slope corresponding to the maximum inclination of the lower housing, and any desired azimuthal angle within that cone.

The pointing orienter includes sensors which record the axial displacement and angular displacement (i.e. an angle through which rotation has occurred) of the bearing block. Further sensors measure the actual position and orientation of the drill bit. Using these sensors, an operator may set a desired path for the borehole, and monitor the orientation if the pointer orienter and the development of the path, modifying the path as results generated by the sensors appear. Some or all of the control process may of course be automatic, the processing being effected by a processing unit located above ground or installed somewhere in the drill string.

The flowtube 50 is necessary to allow tools or fluids to pass down the drill string. The flowtube is made from a material sufficiently strong and flexible to bend and remain integral as the pointing orienter pivots about the ball joint.

Figure 6:
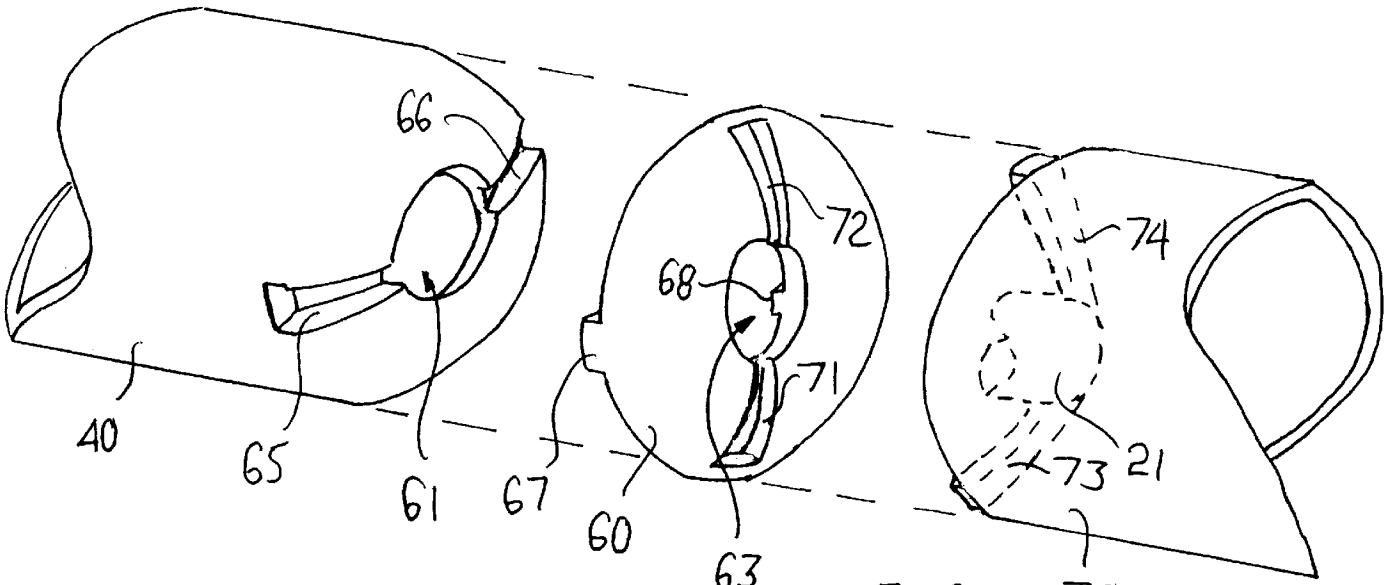
FIG. 6 is a exploded perspective view of part of another embodiment of the directional drilling assembly.
Figure 7:
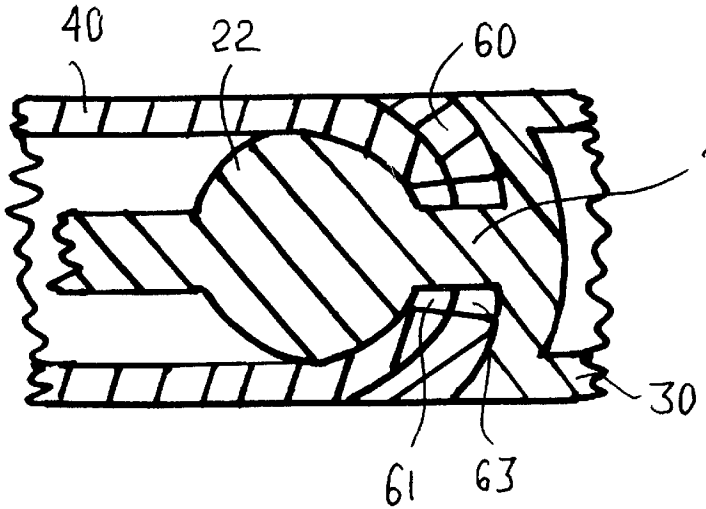
FIG. 7 is a longitudinal section of part of that further directional drilling assembly.

FIGS. 6 and 7 show the ball joint structure in more detail. The upper housing 40 has a protruding spherical end which houses the ball joint 22. Between the upper housing 40 and the lower housing 30 is a semi-spherical plate 60. The lower housing 30 has a spherically recessed end. The radii of the ball joint 22, the spherical end of the upper housing 40, the plate 60, and the lower housing 30 are engaged firmly as s own in FIG. 7, but allow movement between the respective abutting surfaces. The ball joint 22 is fixed to the lower housing 30 by a stalk 21, which extends through central circular apertures 61, 63 in the upper housing and plate respectively. The radius of the apertures 61, 63 is greater than that of the stalk, allowing the ball joint 22 to pivot so as to incline the stalk by approximately 4° away from the axis in any direction.

The spherical end of the upper housing 40 includes two opposing radial slots 65, 66. The concave surface of the plate 60 includes corresponding splines 67, 68 which engage in the slots. The convex surface of the plate 60 includes two opposing radial slots 71, 72 similar to those of the upper housing, except that the slots 71, 72 are perpendicular to the slots 65, 66 and splines 67, 68. The recessed spherical surface of the lower housing 40 includes splines 73, 74 which correspond to and engage with the slots 71, 72 (the splines 73, 74 are, apart from their orientation, similar to the splines 67, 68).

It will be seen that the slots 65, 66 and splines 67, 68 allow the ball joint to pivot in a first plane, whilst the slots 71, 72 and splines 73, 74 allow the ball joint to pivot in a second plane perpendicular to the first, so giving the ball joint freedom to orient itself within a cone having sides inclined at approximately 4° from the upper housing's axis; however, no rotation of the lower housing about the upper housing's axis is permitted. This arrangement thus conveniently couples the upper and lower housings, and transfers torsional forces from the lower housing to the upper housing.

Figure 8:
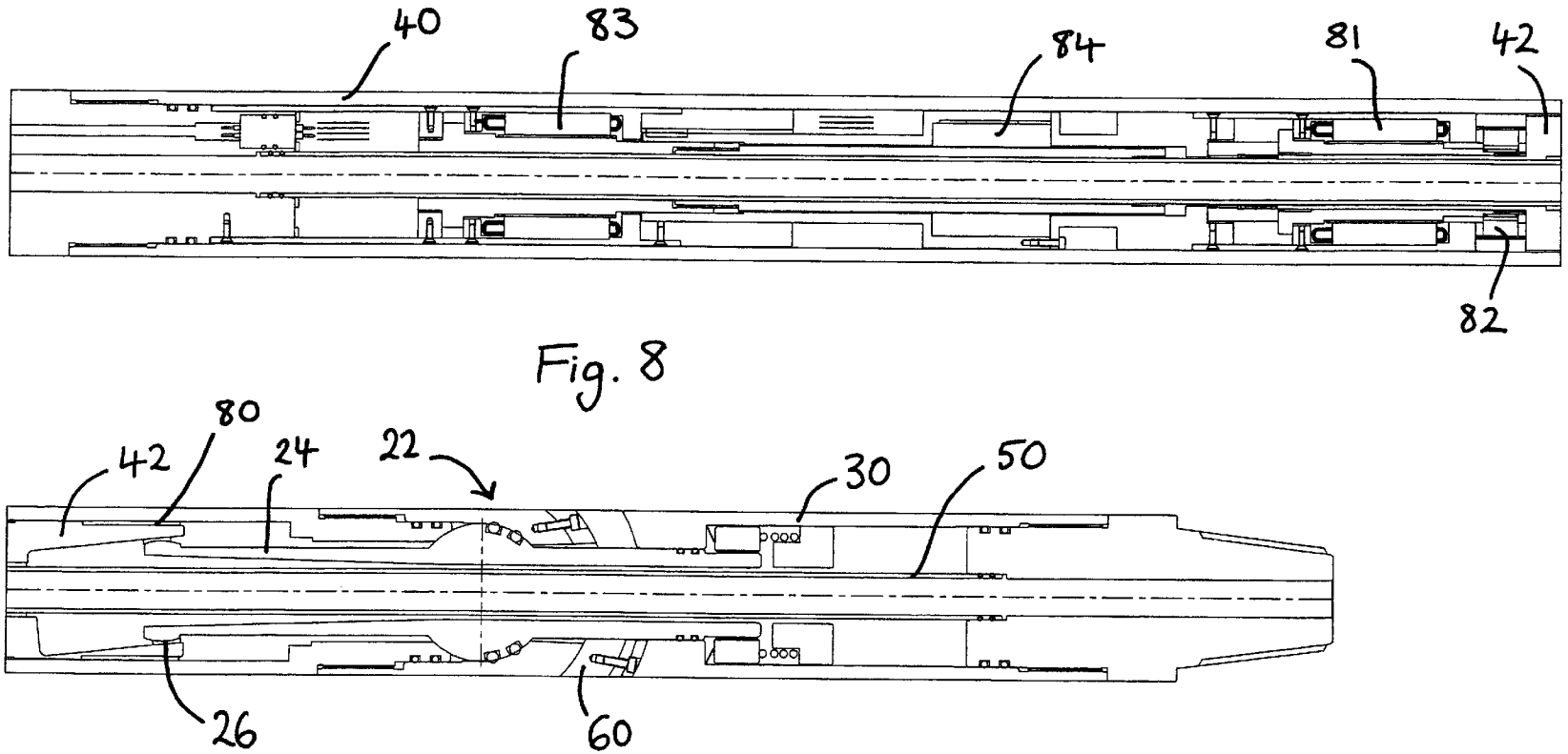
FIG. 8 shows a more detailed embodiment of the present orienter, in 2 sections.

FIG. 8 shows the present orienter in more detail. The bearing block or collar 42 is mounted in a journal bearing 80. A motor 81 is mounted close to the bearing block 42 and coupled to it via a gearbox 82; this motor controls the rotation of the bearing block. A second motor 83 is mounted near the up well end of the assembly, and controls the linear movement of the bearing block via a linear actuator 84 which converts the rotation of the motor into longitudinal movement.

The torsional force upon the pointing orienter depends upon the inclination of the drill string below the pointing orienter, its length, and force generated by the drill bit. At large inclinations, further strengthening of the pointing orienter may be necessary. The lower end of the upper housing may include inwardly directed longitudinal spines on its inner surface, these splines engaging with corresponding grooves on the bearing block when the bearing block is displaced past a predetermined amount and corresponding to a predetermine torque. The splines will then help lock the pointing orienter when large torsional loads are exerted upon it. It will be apparent that the azimuthal angle can only be adjusted when the bearing block is not engaged by the splines, and the angular position of the bearing block beyond the predetermined point of engagement is limited by the number of engaging positions. In order to change the azimuthal angle of the lower housing when highly inclined, the inclination must be reduced until the bearing block disengages; the bearing block re-engaged at a different angular position before the inclination of the lower housing is increased.

Naturally, the splines may be situated upon the bearing block, engaging with grooves present upon the inner surface of the upper housing or with the splines and grooves distributed between the bearing block and upper housing. Some type of spline mechanism or other torsion limiting mechanism could alternatively or additionally be included elsewhere the pointing orienter, for example between the bearing and the bearing block, or the ball joint and the housings.

It will be realized that other types of universal joint may be substituted or combined with the ball joint, such as a Hooke's joint.

The dimensions of the pointing orienter are dictated by the drill string it is to be incorporated in, and the environment it is to be used in. The maximum inclination of the lower housing is determined by the inclination of the blind bore. Besides the 15 bearing of the blind bore, the length of the crank arm and the blind bore will determine degree to which the inclination varies as the bearing blocks displacement varies.

It will be apparent that specific features disclosed herein could be combined with features of known orienter devices. It will be realized that although not deriving the full benefit of the improvements, the present pointing orienter could be combined with a bent sub assembly. Also, alternative driving means may be substituted for the mud motor, for example an electric motor situated between the drill bit and the orienter. An electric power cable, and ether cabling, may conveniently be disposed inside the drill string, passing through the orienter; since the housings do not rotate relative to each other, the cabling may be eccentrically disposed and need only be flexible enough to withstand the changes in inclination (magnitude) and azimuth between the upper and lower housings.

What is claimed is:

1. An orienter comprising a main body couplable to a drill string, a nose tubing movably mounted in the main body, and a collar with a bore which engages in a cam-like manner with the nose tubing and movable to control the orientation of the nose tubing, where the, coil is movable longitudinally and circumferentially to control both angle of inclination and the azimuth of the nose tubing.

2. An orienter according to claim 1 wherein the mounting of the nose tubing is a universal joint.

3. An orienter according to claim 2 wherein the collar engages with an extension of the nose tubing on the drill string side of the universal joint.

4. An orienter according to claim 3 wherein the nose tubing is aligned on both sides of the universal joint and the bore of the collar is angled relative to the main axis of the main body.

5. An orienter according to claim 1 wherein the collar is hydraulically controlled.

6. An orienter according to claim 1 wherein the collar is electrically controlled.

* * * * *